United States Patent [19]

Rhodes, Jr.

[11] Patent Number: 4,760,932

[45] Date of Patent: Aug. 2, 1988

[54] SEGMENTED, COLLAPSIBLE, RIGID LIQUID STORAGE TANK

[75] Inventor: Gilbert A. Rhodes, Jr., Clinton, Md.

[73] Assignee: The United States of America as represented by the Secretary of the Army, Washington, D.C.

[21] Appl. No.: 90,285

[22] Filed: Aug. 28, 1987

[51] Int. Cl.[4] ..... B65D 88/08

[52] U.S. Cl. ..... 220/5 A; 52/192

[58] Field of Search ..... 220/5 A, 5 R; 52/192

[56] References Cited

U.S. PATENT DOCUMENTS

| | | | |
|---|---|---|---|
| 1,378,725 | 5/1921 | Ryan | 220/5 A |
| 1,494,818 | 5/1924 | Shean | 220/5 A |
| 1,943,191 | 1/1934 | Schwemlein | 220/5 A |
| 2,126,997 | 8/1938 | Kramer | 220/5 A |
| 2,337,058 | 12/1943 | McKee | 220/5 A |
| 2,953,276 | 9/1960 | Dunn | 220/5 A |
| 4,714,170 | 12/1987 | Scott | 220/5 A |

FOREIGN PATENT DOCUMENTS

| | | | |
|---|---|---|---|
| 2303721 | 10/1976 | France | 220/5 A |

*Primary Examiner*—Jimmy G. Foster

*Attorney, Agent, or Firm*—John E. Becker; Anthony T. Lane

[57] ABSTRACT

A portable, collapsible tank for storing liquids which may be assembled in top, bottom, and side wall subassembly sections. The sections may be transported in compact substantially flat sections and easily assembled and disassembled in the field to provide greatly differing fluid capacities as desired. Arcuately segmented, interconnectable combination joining and supporting rings including sealing gaskets are provided for assembly and support of the multi-segmented relatively light weight top, bottom, and side wall subassembly sections fabricated of fiberglass or Kevlar type reinforced plastic materials. Segmented top and bottom walls are also formed of light weight, compact plastic material plate sections and are disposed atop and beneath the interposed wall sections. The tank assembly is further supported and stabilized by a center support pole in combination with top and bottom flange assemblies respectively. Multiple tiers formed of superposed side wall subassemblies, as well as preselected overall diameters of the 360° wall-enclosed tiers, collectively provide for the selective highly variable capacity of these relatively rapidly constructible and dismantable or collapsible storage tanks.

17 Claims, 2 Drawing Sheets

FIG. 2
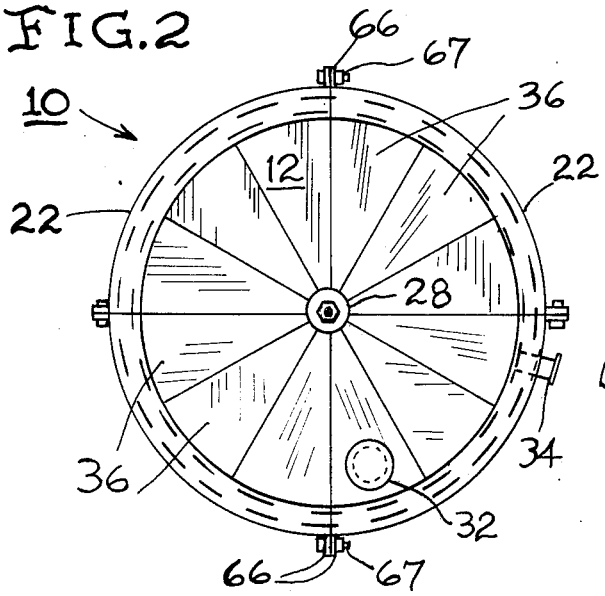
FIG. 3
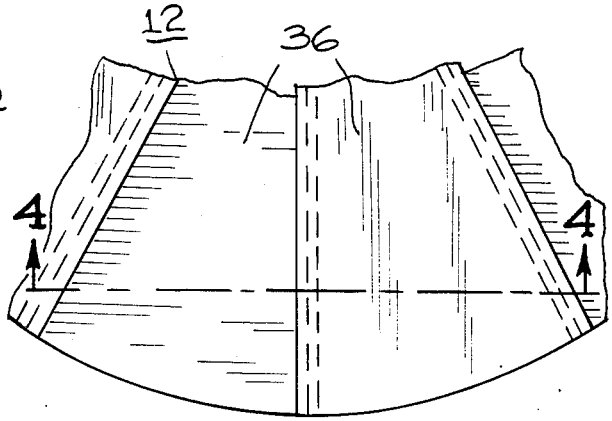
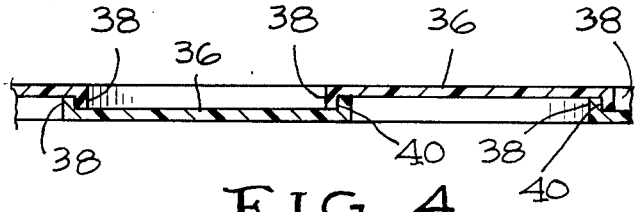
FIG. 4
FIG. 1
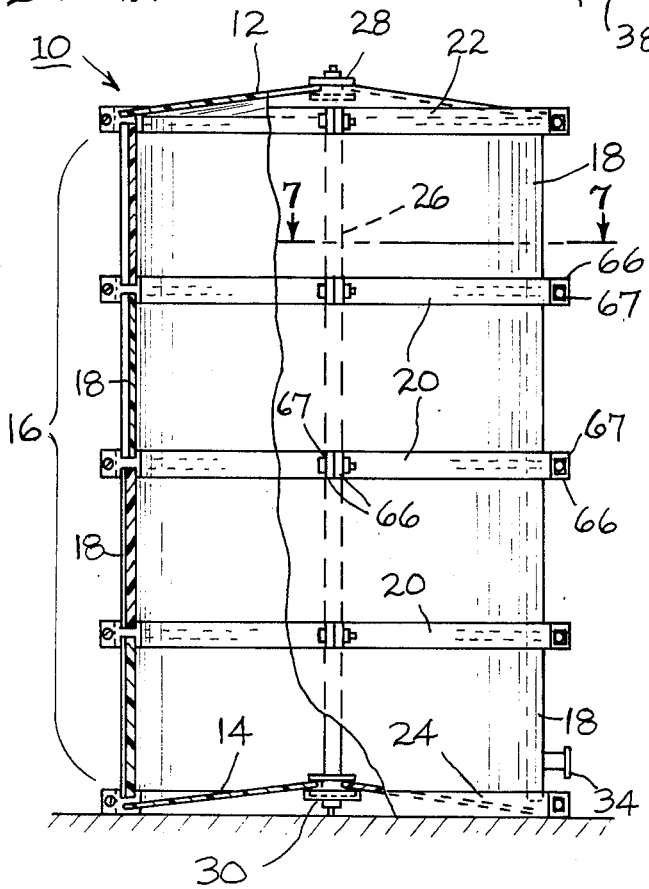
FIG. 5
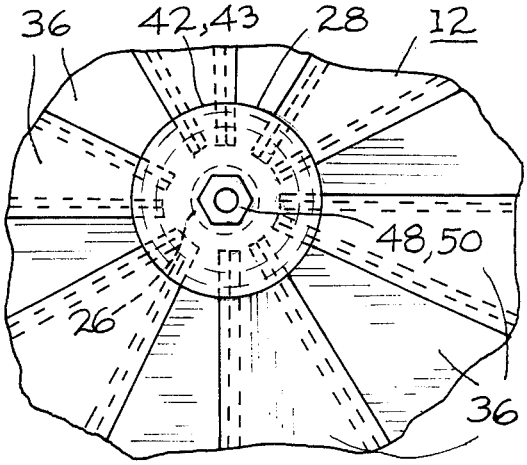
FIG. 6
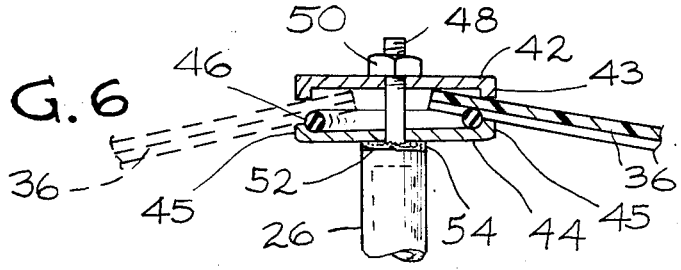

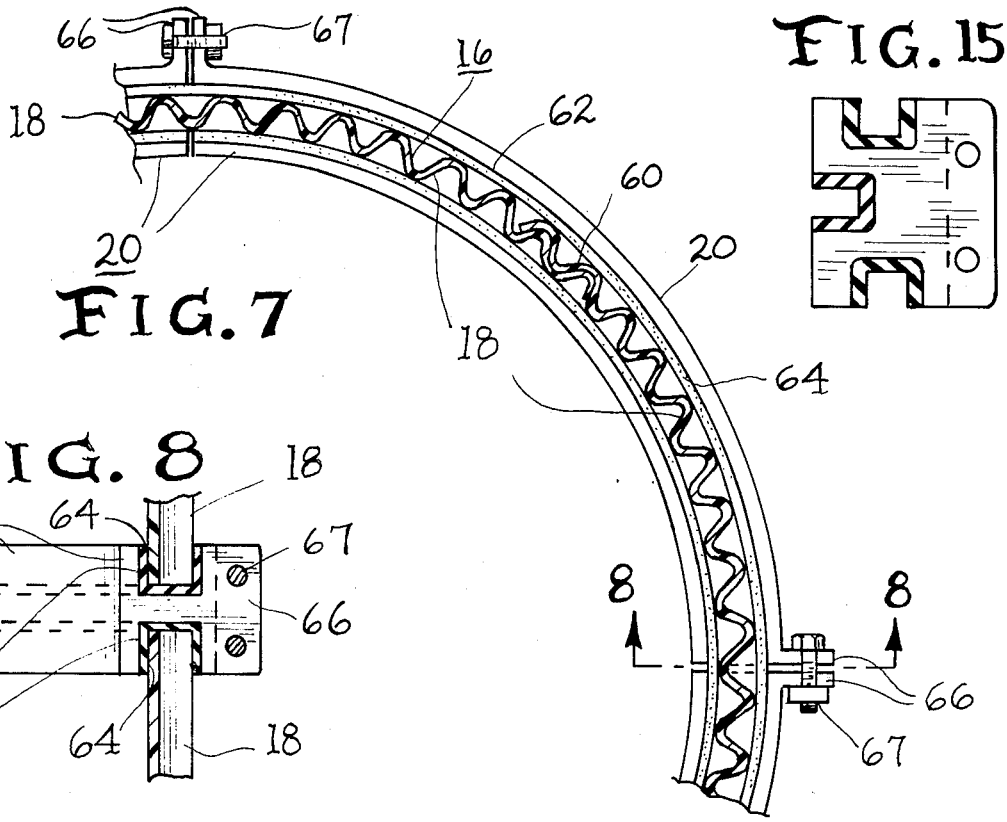
FIG. 7
FIG. 15
FIG. 8
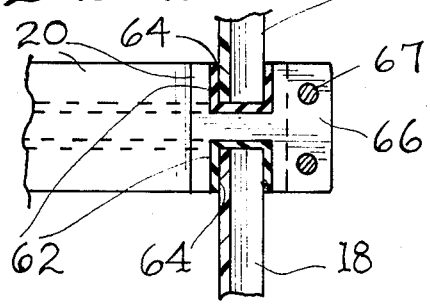
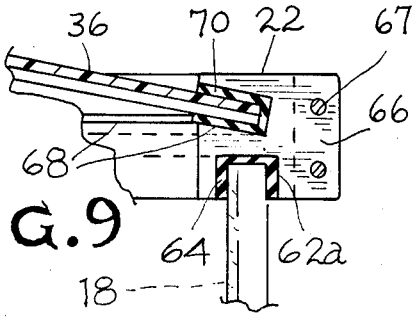
FIG. 9
FIG. 12
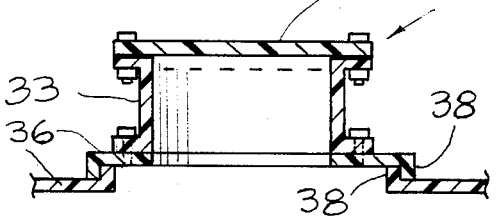
FIG. 10
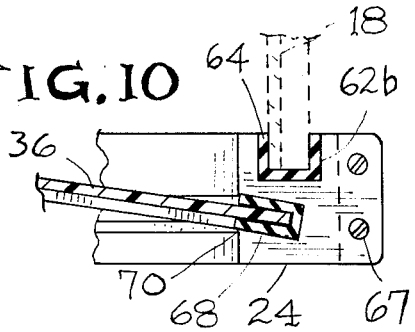
FIG. 13
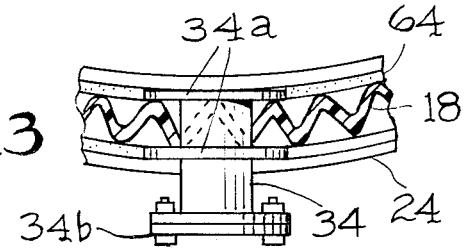
FIG. 11
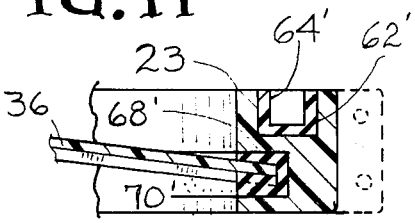
FIG. 14
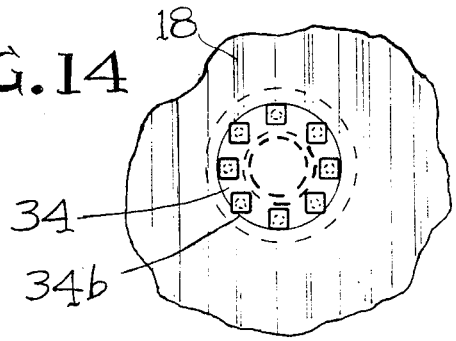

SEGMENTED, COLLAPSIBLE, RIGID LIQUID STORAGE TANK

GOVERNMENT INTEREST STATEMENT

The invention described herein may be manufactured, used, and licensed by or for the U.S. Government for governmental purposes without the payment to me of any royalties thereon, and may become assigned outright to the U.S. Government.

BACKGROUND OF THE INVENTION

The invention relates generally to storage tanks, and more specifically to segmented tanks which may be rapidly assembled in top, bottom, and side wall sections or segments which may be transported in substantially flat sections and assembled in the field to provide differing fluid capacities as desired.

Many conventional storage tanks heretofore have been built of steel or other unduly heavy plate materials, and joined together by bolting, riveting or welding. Additionally, they require a large amount of expensive support equipment, such as cranes, hand tools, riveting and/or welding equipment and the like, to fasten their plates together. They also involve intensive and skilled laborers and are quite time consuming.

Examples of known portable storage tanks may be found in U.S. Pat. Nos. 3,280,408; 3,225,362; and 4,305,518 which disclose various arrangements of providing an integral storage tank by assembling sectional pieces. However, these tanks also have various other drawbacks such as not contemplating or providing for substantially all sections to be storable and transportable along with appropriate unique sectional top and bottom wall members to further reduce bulk of the collective sections.

SUMMARY AND OBJECTS THE INVENTION

According to the present invention an improved collapsible segmented liquid storage tank which is lightweight and readily shipable in the dismantled state, can be provided by utilizing corrugated or accordian-type pleated wall sections of fiberglass or Kevlar reinforced plastic suppported so as to be assembled in an integral manner, with certain selectively variable liquid capacity, through employment of gasketed joining support rings. These rings also serve along with a central support pole to provide support and sealing for the accompanying sectional top and bottom walls also fabricated preferably of fiberglass or Kevlar reinforced plastic material.

Accordingly, an important object of the present invention is to provide a relatively lightweight, collapsible, storage tank which may be transported in a relatively flat, compact package and assembled and disassembled at the usage site.

Another important object is to provide a collapsible storage tank having top and bottom walls of sectional construction so as to further facilitate transport and storage, and which tank is capable of being assembled and disassembled with unskilled labor and less sophisticated tools and equipment.

Still another important object of the present invention is to provide a sectional or segmented collapsible storage tank with efficient sealing rings, the tank being so configured as to provide for differing capacities of liquid by providing and assembling differing numbers of sealing rings and sidewall sub-assembly sections in the form of one or more 360° tiers.

Yet another important object of the present invention is to provide a collapsible storage tank which not only is lightweight in construction, through the use of reinforced plastic top, bottom, and side walls, but which also is very strong, through the collective use of the combination joining and sealing rings adding resistance to wind and moment loads.

The construction designed to carry out the invention will be hereinafter described in more detail together with other features thereof.

BRIEF DESCRIPTION OF THE DRAWINGS

The invention will be more readily understood from a reading of the following specification and by reference to the accompanying illustrative exemplary drawings forming a part thereof.

FIG. 1 is an elevational view of the assembled collapsible storage tank according to the invention, with some portions being broken away and shown in cross-section to reveal details of construction;

FIG. 2 is a top plan view of the tank of FIG. 1, illustrating the segmented structure of a top wall constructed according to the invention;

FIG. 3 is a fragmentary, enlarged detail view of a portion of the top or bottom wall further illustrating the plate segments thereof;

FIG. 4 is a fragmentary detail vertical cross-sectional view taken along line 4—4 of FIG. 3, illustrating the junction detail of plate sections;

FIG. 5 is a partial plan view illustrating some detail of the top or bottom retaining flange assembly;

FIG. 6 is a detail vertical cross-sectional view taken along line 6—6 of FIG. 5 more fully illustrating the top or bottom flange assembly;

FIG. 7 is a partial horizontal cross-sectional view taken along line 7—7 of FIG. 1, showing the structure of a side wall section and supporting ring;

FIG. 8 is a detail end view taken on line 8—8 of FIG. 7, showing the opposed twin grooves and a connecting flange portion of an arcuate segment of an intermediate supporting and retaining or joining ring for cooperative retention of adjoining horizontal edges of tank sidewall portions;

FIG. 9 is a similar detail end view showing the transverse groove character at a connecting flange portion of an arcuate segment of a top supporting, ring and showing the joining of the top wall and side wall sections;

FIG. 10 is a view similar to FIG. 9, but modified to show the joining of the bottom wall and a side wall section;

FIG. 11 is a cross-sectional detail view through another modified embodiment of a combined joining and sealing ring member which can be used as both a top and a bottom ring;

FIG. 12 is an exemplary cross-sectional detail view through the manhole or access port in a segment of the top cover member;

FIG. 13 is a plan view of a typical discharge/filler pipe connection viewed through a fragmentary side wall cross-section;

FIG. 14 is an outer end elevational view of the pipe connection of FIG. 13; and FIG. 15 is a further cross-sectional detail view through another modified more universal embodiment of a combined joining and sealing ring member, similar to that relating to FIG. 11.

DESCRIPTION OF A PREFERRED EMBODIMENT

Like reference numbers represent like parts throughout the various figures. First referring to FIG. 1, the drawing illustrates a fully assembled generally cylindrical composite storage tank 10 readily assembled and disassembled from a plurality of sections which include a top wall assembly 12, a bottom wall assembly 14, and a side wall assembly 16. Side wall assembly 16 is constructed of a plurality of suitably corrugated or pleated side wall panels or sections 18 with successive tiers thereof being joined by intermediate supporting rings 20. Side wall assembly 16 is joined to top wall assembly 12 by means of top supporting ring means 22, and similarly joined to bottom wall assembly 14 by of bottom supporting ring means 24. In addition to the support provided by side wall assembly 16, top wall assembly 12 is also supported by top support pole 26 centrally disposed in tank 10. Top support pole 26 is preferably of a known selectively adjustable telescopic or other selectively variable length character. Pole 26 is substantially centrally connected at its upper end with top wall assembly 12 by means of top flange assembly 28, and similarly centrally connected at its lower end with bottom wall assembly 14 by means of a like bottom flange assembly 30, thus providing for its support. Additional support is obtained when fully filled with a liquid to be stored, such as water or fuel.

Disposed in the top wall assembly 12 is a covered manhole 32 (FIGS. 2 and 12) for access to the interior of tank 10. Disposed in side wall assembly 16 near its lower edge is a fluid connection pipe means 34 for filling and/or draining tank 10. Additional fluid connections may be placed where and if desired in the walls of tank 10. Bottom wall assembly 14 may be constructed in a substantially identical manner to that of top wall assembly 12. Bottom flange assembly 30 may be constructed in a substantially identical manner to that of top flange assembly 28 except that during tank assembly the bottom flange assembly 30 is inverted as per FIG. 1 in order to complete the attachment of centered top support pole 26.

Referring to FIGS. 2, 3, and 4, top wall assembly 12 is of circular configuration and comprises a plurality of generally triangular or pie-shaped flanged plate segments 36. Plate segments 36 are preferably substantially identically formed and provided with short transversely formed radial edge flanges 38. Adjacent plates are disposed with their flanges alternately complementally interlocking, as better seen in FIG. 4, to form joints 40 in a basically fluid tight manner. Additional sealing compound may be applied, as will be described hereinafter. Plates 36 are assembled to preferably have a shallow or flattened cone form, for example inclining at approximately 5°. Bottom wall assembly 14, as seen in FIG. 1, is constructed in a substantially identical manner to that of top wall assembly 12 and therefore need not be further described. As an alternative arrangement, the bottom wall assembly may be inverted from that of the top wall assembly. The inverted apex may be accomodated either by a heightened bottom supporting ring lower skirt plus some auxiliary graded earthern support; or by slightly excavating with contour grading of the earth at the middle center area. The tanks normally will be erected and supported on a prepared earthen surface. Where the tanks will be used to store fuel type liquids, the earth preferably will be significantly bermed up around the tank periphery to serve an ecological containment or confinement function for any leaking fuel in the event the tank becomes damaged or otherwise develops a serious leakage problem.

Referring to FIGS. 5 and 6, top flange assembly 28 preferably comprises outer flange member 42, inner flange member 44, flange seal 46, threaded stud 48 and nut 50. Flange seal 46 is preferably of the O-ring type and is disposed on inner flange member 44, preferably being concentrically retained by peripheral flange lip 45 within the top flange assembly 28. Top wall assembly 12 has its innermost portions sandwiched or disposed between outer flange 42 and inner flange 44 so as to sealingly engage flange seal 46 along the inner surface of top wall 12. Threaded stud 48 is coaxially attached to the upper end of top support pole 26 by any conventional means, such as pinning or welding, and in a manner so as to provide for or expose a concentric shoulder 52 near the end of pole 26. Outer flange member 42 and inner flange member 44 are so configured and centrally apertured as to respectively slidingly engage stud 48 along their central axis while being supported upon the concentric shoulder 52. Nut 50 threadingly engages stud 48 so as to adjustably travel therealong and bear against outer flange member 42. Top wall assembly 12 and flange assembly 28 are so configured as to allow insertion of stud 48 at its central axis while providing for complete gasketed sealing engagement with the appropriately sized flange seal 46. To provide for further sealing, a shoulder seal 54 (FIG. 6) may be disposed between concentric shoulder 52 and inner flange 44. During assembly of top flange assembly 28, shoulder seal 52, inner flange member 45, flange seal 46, top wall 12, and outer flange member 42 are sequentially placed over stud 48. Nut 50 is adjusted so as to bear against outer flange member 42. Outer flange member 42 in turn forces top wall segments 36 to become sealingly engaged with adjacent O-ring seal 46 supported by inner flange member 44. Inner flange member 44 also sealingly engages any shoulder seal 54 in its engagement with concentric shoulder 52 of top support pole 26. Top flange assembly 28 thus serves the dual purpose of attaching top wall assembly 12 to top support pole 26 and also maintain the integrity of top wall assembly 12. Bottom flange assembly 30, as seen in FIG. 1, is configured and functions in a substantially identical manner to that of top flange assembly 28, excepting that it is inverted, preferably uses another O-ring to seal flange member 42, and forms the lower end connection of the center support pole 26 with the bottom wall assembly 14.

Referring to FIGS. 7, 8, and 9, side wall section 18 are preferably formed in generally over-sized quadrant sections of the KEVLAR or like type of sheet material which is preshaped into either sine wave or accordian-like pleated form. These sections may be also generally preshaped into generally arcuate quadrant or smaller sectioned form which can be assembled with three or more others to form a fully cylindrical wall assembly section 18. Opposed ends of the side wall quadrant sections are overlapped to form section joints 60 (FIG. 7) and appropriately caulked or sealed so as to form a fluid seal. Because the tank is 52 of top support pole 26. Top flange assembly 28 thus serves the dual purpose of attaching top wall assembly 12 to top support pole 26 and also the retaining of plate segments 36 in their assembled configuration so as to maintain the integrity of top wall assembly 12. Bottom flange assembly 30, as seen in FIG. 1, is configured and functions in a substantially identical manner to that of top flange assembly 28, excepting that it includes a second O-ring seal within the other peripheral lip to double seal the flanges which form the lower end connection of the center support pole 26 with the bottom wall assembly 14.

Referring to FIGS. 7, 8, and 9, side wall section 18 are preferably formed in generally over-sized quadrant sections of the Kevlar or like type of sheet material preshaped into either sine wave or accordian-like pleated form. These sections may be also generally preshaped into generally arcuate quadrant form which can be assembled with three others to form a fully cylindrical wall assembly section 18. Opposed ends of the side wall quadrant sections are overlapped to form section joints 60 (FIG. 7) and appropriately caulked or sealed so as to form a fluid seal. Because the tank is erected in sections from the ground up, it is natural to apply the necessary caulking as each segment level is completed. Upper and lower edges of each formed side wall section 18 are seated into gasketed side wall section grooves 62 provided in the upper and lower faces of intermediate supporting rings 20, as better seen in FIGS. 1 and 8. The various intermediate, top, and bottom supporting rings are also of composite form, such as being made of two semi-circular or, more preferably, four quadrant sections for more compact packaging and transport in the disassembled state, such sections being joined as better seen in FIGS. 7, 8, 9 and 13 at ring flanges 66 by conventional means such as by bolt and nut assemblies 67. Continuing with the description of the wall section assemblying, the upper edge of the uppermost wall section assembly 18 becomes seated within a like-gasketed groove **62*a* (FIG. 9) provided within the lower face of top supporting ring 22. Likewise, the lower edge of the tank's lowermost wall section assembly 18 becomes seated within a like-gasketed groove 62*b* (FIG. 10) provided in the upper face of the bottom supporting ring 24 to generally complete the assembly of sidewall assembly 16 of tank 10. Disposed within each of the combined joining and supporting ring grooves 62, 62*a*, 62*b* is a ring gasket 64. Ring gaskets 64 are of generally U-shape cross-section and of a size and character so as to assure fluid sealing engagement of side wall sections 18 with side wall section grooves 62. Ring gaskets 64** are preferably made in one piece but it is contemplated that they also might be made of two or more arcuate segments.

In addition to the aforesaid gasketed grooves **62*a* and 62*b*, respectively, in the respective top and bottom supporting rings 22 and 24, each ring is further provided in its inner face with a generally transversely disposed similarly gasketed groove 68, which may be slightly downwardly angled relative to the vertical axis of the tank 10, and adapted to receive the slightly sloping outer peripheral edge of top wall assembly 12 and bottom wall assembly 14. Similar ring-type closure gaskets 70 are disposed within each closure groove 68, assuring fluid sealing engagement of top and bottom walls with their respective closure grooves. Top supporting ring assembly 22 and bottom supporting ring assembly 24 are slightly differently configured (FIGS. 9 and 10) but they may be identically configured to reduce parts inventory by use of the form 23 shown in the cross-sectional detail view of FIG. 11. This interchangeable ring, generally designated 23, includes only one vertically disposed annular groove 62' adapted to receive its gasket 64'. Its corresponding innermost face is provided with a 90° transversely disposed groove 68' which preferably may be somewhat oversize to that of groove 68 in the form of FIGS. 9 and 10. Thus, by utilizing correspondingly oversize deformable gaskets 70' in said oversized transverse groove 68', which later groove is not downwardly or upwardly angled relative to the vertical axis of tank 10, the greater thickness of suitably deformable gasket material will accomodate the slight angular relationship generated by the shallow cone relationship of the top and bottom walls' assembled segments 36. Thus, by inverting the top supporting ring 23, shown as a bottom supporting ring in FIG. 11, it can be also used as a top supporting ring. Further contemplated is yet another form of alternative ring configuration as shown in FIG. 15, wherein both upper and lower faces of each support ring contain the aforesaid opposed twin grooves as per FIG. 8, and the innermost face contains a suitably transverse closure groove and gasket arrangement similar to that in FIG. 11**. This would allow the use of a single universal ring configuration to serve as each of top, bottom, and intermediate support rings. This would further reduce the parts inventory, but with some grooves not being used in a particular application.

Reference is next made to FIG. 12 which is a fragmentary cross-sectional view thru an illustrative ingress-egress manhole assembly 32 provided in one of the top wall's segmented plates 36. The manhole assembly may comprise an oppositely flanged collar portion 33 with the lower flange suitably fastened over the access aperture to the plate member 36. The upper flange and cover plate **33*a*** may be appropriately complementarly apertured to accomodate suitable fasteners such as conventional threaded bolts. The diameter of the manhole access opening should be of approximately two foot diameter to permit a worker to easily enter and exit to help with final assembly, caulking or sealing applications and possible repairs and the like as may be needed.

Referring next to FIGS. 13 and 14, there is represented an illustrative form of a generally typical pipe coupling or connection means generally designated 34. As shown, this pipe connection means comprises a spaced pair of retaining or mounting flanges **34*a* suitably affixed to the main pipe section so as to sealingly embrace and affix it to the corrugated wall section 18. The outer free end of the main pipe section may be provided with any suitable flange and/or cover plate means generally designated 34*b***. Suitable check valve means, not shown, may be incorporated therewith as necessary.

A variety of materials can be employed to form the various parts of the collapsible tank of the invention. For example, the gaskets and flange seals are preferably of cured epichlorohydrin ethylene oxide rubber, ECO rubber hydrin 400 by B. F. Goodrich Co, or similar material. Side wall corrugated sections and flange assemblies may be made of fiberglass or Kevlar (trademark) reinforced plastic or other similar material having high strength, light weight, and which are impervious to hydrocarbon fuels. The tank top and bottom wall plate segments may be made of materials similar to that of the side wall sections. Support rings may be made of aluminum, Kevlar, fiberglass reinforced plastic or other similar materials also having high strength, light weight, and which are also impervious to hydrocarbon fuels. Fasteners are preferably of stainless steel. Conventional commercial sealants such as silicone sealants may be used at all joint areas as desired to assure the containment of liquid without sustaining leakage.

From the foregoing description, it is apparent that storage tanks of varying capacity may be assembled, depending upon both the diameter selected and the overall height dictated by the number and size of sectioned tiers needed to attain a desired capacity. The following table provides some contemplated different size tanks which can be readily assembled and disassembled using the technology disclosed herein.

| Capacity (bbl) | Capacity (gal) | No. of Rings | Height (ft) | Approx. Inside Dia | Approx. volume displacement (cu ft) |
|---|---|---|---|---|---|
| 100 | 4,200 | 1 | 8 | 9'-3" | 235 |
| 250 | 10,500 | 1 | 8 | 15'-5" | 212 |
| 500 | 21,500 | 1 | 8 | 21'-7" | 292 |
| 1,000 | 42,000 | 1 | 8 | 29'-9" | 460 |
| 3,000 | 126,000 | 3 | 24 | 29'-9" | 746 |
| 10,000 | 420,000 | 3 | 24 | 55'-0" | 1,506 |
| 50,000 | 2,100,000 | 4 | 32 | 33'-6" | 28,077 |

In conclusion, from the foregoing detailed description and illustrative drawings, it is apparent that the objectives and advantages of this invention have been fully met. Various other changes and modifications may be made to the preferred embodiments described herein as will be briefly described. For example, where multiple tier form tanks are contemplated, the relative thickness and flexibility of the corrugated side wall panels will be necessarily increased and decreased respectively as needed to support the desired liquid capacity and load. Also depending upon the relative size of desired tank, for some forms the side wall corrugated panels may be of a character which will enable them to be packaged in relatively flat or nonarcuate form for ease of packaging and transporting. For other type tanks, the said side wall panels may be of positive arcuate preshaped form having lesser flexibility. These and other modifications, such as fewer segments in the top and bottom walls, may be made without departing from the spirit and scope of this invention as defined in the appended claims.

What is claimed is:

1. A self-supportable, rigid, liquid storage tank adaptable for relatively rapid assembly and disassembly, characterized by relatively lightweight composite top, bottom, and side wall subassembly sections which can be stowed in one or more relatively flat lightweight packages for ease of handling and transporting, with the number of side wall sections being selective to form one or more tiers to vary the tank capacity, said tank comprising in combination:

(a) generally circular, vertically spaced apart top and bottom composite wall subassemblies, each comprising a plurality of substantially identical generally pie-shape, releasably interengageable plate segments;

(b) at least one compositely formed annular side wall subassembly section, each side wall subassembly section including at least two arcuately formable side wall corrugated panels with lateral end portions adaptable to complementally mate or nest in overlapping relationship with its adjacent panel to complete a 360° enclosure forming one tier;

(c) a center pole support means interposable upright between and having means for releasably interconnecting said bottom and top wall sections;

(d) annular combination tank-supporting and tank-sealing ring means, which means includes at least one ring subassembly disposed at the top and bottom respectively of said tank to cooperatively support, interconnect, and seal said respective top, bottom and side wall subassemblies;

said ring subassemblies each comprising at least two releasably interconnectable arcuate ring-forming members with grooves containing sealing gasket means; and (e) said tank further including fluid inlet-outlet means to facilitate both filling and draining said tank.

2. The tank of claim 1, wherein said top and bottom wall sections of paragraph (a) are of flattened cone-shape form.

3. The tank of claim 1, wherein said annular combination tank-supporting and tank-sealing ring means of paragraph (d) further include at least one intermediate ring subassembly adaptable to be interposed between at least one pair of superposable tiered sidewall sections; and each of said intermediate ring subassemblies also comprising at least two releasably interconnectable arcuate ring-forming members with grooves containing sealing gasket means.

4. The tank of claim 3, including at least two tiers of side wall subassemblies, wherein the plural ring-forming members of paragraph (d) which comprise an intermediate joining and sealing ring means between superposable tiered wall sections have collective upper, lower, and inwardly facing edges, and said upper and lower facing edges each having coplanar oppositely facing vertically oriented grooves for receiving both the gasket means and related upper and lower edges of said side wall subassembly panels.

5. The tank of claim 1, wherein said generally pie-shape plate segments forming said top and bottom wall sections of paragraph (a) having uniform transversely formed radial side flanges adaptable to facilitate a releasable interengageable assembly of adjacent plate segments.

6. The tank of claim 1, which comprises a plurality of side wall tiers each formed of said side wall subassembly sections, and an annular combination tank-supporting and tank-sealing ring subassembly interposed between each of said tiers.

7. The tank of claim 1, wherein each of said side wall subassemblies of paragraph (b) includes between two and four corrugated side wall panels to comprise each 360° enclosure tier.

8. The tank of claim 1, wherein the combination tank-supporting and tank-sealing ring sub-assembly means of paragraph (d) comprise between two and four of the arcuate, grooved, ring-forming members, each of said members terminating in ends having complementary, apertured, bolting flanges with appropriate bolt-fastening means.

9. The tank of claim 1, wherein the plural ring-forming members of paragraph (d) which comprise said top disposed ring means have a collective bottom edge with an annular downwardly facing gasket-receiving groove, and also a collective innermost edge with an inwardly facing annular gasket-receiving groove disposed transversely relative to the bottom edge groove;

and those ring-forming members which comprise said bottom disposed ring means have a collective upper edge with an upwardly facing annular gasket-receiving groove, and also have a collective innermost edge with an inwardly facing annular gasket-receiving groove disposed transversely to the top edge groove;

said respective downwardly and upwardly facing grooves of said ring members being substantially vertically coplanarly aligned and assembled upon respective related upper and lower edges of said side wall subassembly panels; and said respective inwardly facing grooves of said top and bottom disposed ring means assembled around and upon outer peripheral edges of said respective top and bottom wall subassembly sections.

10. The tank of claim 1, wherein said plural ring-forming members of paragraph (d) which comprise the top and bottom disposed combination tank-supporting and tank-sealing ring means are of common interchangeable or universal character by the provision of only one gasket-receiving groove vertically oriented in one of either top or bottom oppositely facing edges; and the further provision of the gasket-receiving groove in the innermost collective edge thereof being disposed substantially 90° transversely to said vertically oriented groove, and said innermost-edge-disposed groove and gasket means therein being so relatively dimensioned as to accomodate the receipt of either upwardly or downwardly slightly angled relationship of outer peripheral edge portions of said composite top and bottom plate-assembled wall sections;

whereby said combination ring means are selectively universally orientable and useable by merely inverting one relative to another to achieve the requisite top and bottom disposition thereof.

11. The tank of claim 1, wherein said corrugated side wall panels, and said top and bottom wall subassemblies are fabricated of a relatively light weight, high strength material which is impervious to hydrocarbon fuels, and may be selected from a family of various plastic and reenforced plastic materials including fiberglass, Kevlar, and Kevlar type materials.

12. The tank of claim 1, wherein said combination tank-supporting and tank-sealing ring-forming members of paragraph (d) are fabricated of a relatively light weight, high strength material impervious to hydrocarbon fuels, and may be selected from the group of materials including aluminum (6063), fiberglass, and fiberglass reenforced plastic such as Kevlar and the like.

13. The tank of claim 1, further including openable-closeable covered manhole means disposed in operative relationship with said composite top wall subassembly, said manhole means being of a size to readily accomodate ingress-egress of service and repair personnel.

14. The tank of claim 1, wherein said gasket means and any related sealing means are fabricated of resilient rubber and rubber-like material which minimizes aluminium corrosion and is impervious to hydrocarbon fuels, such materials including Epichlorohydrin ethylene oxide rubber, and ECO rubber hydrin 400.

15. The tank of claim 1, wherein said center pole support means of paragraph (c) includes two pairs of gasketed flange assemblies with means for attaching and detaching each pair in liquid-sealing relation to opposed top and bottom faces of said respective top and bottom wall subassemblies of said tank.

16. The tank of claim 3, wherein said ring-forming members of paragraph (d) include a body of universal character having two vertically aligned oppositely facing coplanar potential gasket-receivable grooves, one each opening in respective top and bottom body faces, and another transversely disposed potential gasket-receivable groove in an innermost face of the body and disposed between said two coplanar grooves, said ring-forming members adaptable to form complete 360° ring means subassemblies which are commonly functionable as said combined tank-supporting and tank-sealing ring means for each of a top, bottom, and also an intermediate ring subassembly usage, and wherein certain ones of said three potential gasket-receivable grooves are unused during certain position applicable uses in the tank assembly.

17. The tank of claim 5, wherein lower level tiers of side wall assemblies have side wall panels of greater strength and thickness than those of higher or uppermost level tiers.

* * * * *